US010043484B2

(12) United States Patent
Silverstein et al.

(10) Patent No.: US 10,043,484 B2
(45) Date of Patent: Aug. 7, 2018

(54) DUAL-TARGET IMAGE COLOR RENDERING

(71) Applicant: Apple Inc., Cupertino, CA (US)

(72) Inventors: D. Amnon Silverstein, Palo Alto, CA (US); Xuemei Zhang, Mountain View, CA (US); Yingjun Bai, San Jose, CA (US); Brandon J. Corey, Palo Alto, CA (US); Yonghui Zhao, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/275,225

(22) Filed: Sep. 23, 2016

(65) Prior Publication Data

US 2017/0098428 A1 Apr. 6, 2017

Related U.S. Application Data

(60) Provisional application No. 62/237,630, filed on Oct. 6, 2015.

(51) Int. Cl.
*G09G 5/06* (2006.01)

(52) U.S. Cl.
CPC ..... *G09G 5/06* (2013.01); *G09G 2320/0666* (2013.01); *G09G 2340/06* (2013.01)

(58) Field of Classification Search
CPC ..... H04N 1/6058; H04N 1/6061; G09G 5/06; G09G 5/502
See application file for complete search history.

(56) References Cited

U.S. PATENT DOCUMENTS

| | | | | |
|---|---|---|---|---|
| 5,373,327 | A | 12/1994 | McGee | |
| 9,472,162 | B2 * | 10/2016 | Stauder | H04N 1/6061 |
| 9,640,140 | B2 * | 5/2017 | Shibuya | G06F 3/1454 |
| 2013/0194321 | A1 * | 8/2013 | Wan | H04N 1/46 345/690 |
| 2013/0335439 | A1 * | 12/2013 | Jeong | G09G 5/02 345/590 |
| 2017/0048561 | A1 * | 2/2017 | Oh | H04N 21/23 |

* cited by examiner

*Primary Examiner* — Antonio A Caschera
(74) *Attorney, Agent, or Firm* — Blank Rome LLP

(57) ABSTRACT

Displaying wide-gamut images as intended on color-managed wide-gamut display systems while rendering a visually consistent image when rendered on targeted narrow-gamut display systems (regardless of whether the narrow-gamut displays are color-managed). Images represented in accordance with this disclosure are referred to as a dual-target images (DTI): one target being the image's original wide-gamut color space, the other target being a specified narrow-gamut color space. The novel representational scheme retains narrow-gamut rendering for those colors in a wide-gamut image that are within the targeted narrow-gamut color space, transitioning to wide-gamut rendering for those colors in the wide-gamut image that are outside the targeted narrow-gamut color space. This approach minimizes pixel clipping when rendering a wide-gamut image for a narrow-gamut display, while allowing the original wide-gamut pixel values to be recovered when rendering for a wide-gamut display.

21 Claims, 4 Drawing Sheets

DUAL-TARGET IMAGE COLOR RENDERING

BACKGROUND

Color displays made using different technologies, or even those of the same technology, often have different primaries and thus different color gamuts. To ensure consistent rendering of an image across different displays, standard color communication protocols such as those promulgated by the International Color Consortium (ICC)—ICC color profiles—may be used to specify how to convert from an image's "native" color space to the target display's color space. In practice, however, some displays either do not support color management or do not support the full ICC specification. (See ICC specification ICC.1:2010-12 (Profile version 4.3.0.0), which is technically equivalent to ISO 15076-1:2010.)

Wider gamut systems, often newer on the market and designed with an awareness of the need to be compatible with older devices, mostly support some form of color management so that images with an attached color profile can be properly displayed. For still images without a color profile, current prevailing practice is to assume they are to be rendered for the sRGB color space. In this way most of the commonly available images can display properly on newer wide-gamut displays, though not taking advantage of the expanded color gamut.

To actually have colors that take advantage of a wide-gamut display, images need to be rendered for the wider gamut during the image's capture so that saturated colors are not clipped. If an image rendered for a wide-gamut display is shown on an sRGB display without color management however, the image's colors will appear desaturated. Herein lies the difficulty with maintaining backward compatibility, especially during the commercial transition period when there is a mixture of systems on the market (e.g., sRGB and wide-gamut displays), all of which do not support proper color management.

SUMMARY

In one embodiment the disclosed technology provides a method to render wide-gamut images correctly on color managed wide-gamut display units and, without modification, on non-color managed display units. The method includes receiving first wide-gamut image data of a scene encoded in a first wide-gamut color space (e.g., the P3 color space) and obtaining a first forward transform to convert the first wide-gamut image data into first narrow-gamut image data, the first narrow-gamut image data having a first narrow-gamut color space (e.g., sRGB), where the first wide-gamut color space (e.g., the ProPhoto RGB color space) is larger than the first narrow-gamut color space (e.g., sRGB). The first forward transform may be applied to the first wide-gamut image data to generate the first narrow-gamut image data. A first recover or reverse transform may be obtained (generated or selected from a number of predetermined transforms) to convert the first narrow-gamut image data to second wide-gamut image data, where the second wide-gamut image data is also encoded in the first wide-gamut color space. Note, if the reverse transform were "perfect" and there was no clipping during the conversion of the first wide-gamut image data to the first narrow-gamut image data, the first and second wide-gamut image data would be the same (within a round-off or computational error in any actual implementation). A first dual-target image (DTI) may be generated by storing the first narrow-gamut image data in a first data portion of a DTI file and the first reverse transform in a first metadata portion of the first DTI file. In one embodiment the first wide-gamut image data may be used to determine a first wide-gamut size metric which may be used to determine the first forward and reverse transforms. In another embodiment, the first gamut size metric may be stored in the DTI's first metadata portion so as to be available during subsequent display operations. If a display at which a DTI is received does not support color management (regardless of whether it is a wide-gamut or narrow-gamut display), the narrow-gamut image data may be displayed directly. If the display supports color management, the narrow-gamut image data may be transformed into the display's color space for display (e.g., through a profile connection space, PCS). In other embodiments computer instructions designed to cause a programmable display system (e.g., a portable media player or a mobile telephone) to perform the described operations may be implemented.

In the future, if industry adopts the P3 gamut as the display standard and later moves to even wider gamut displays (identified here as "P3+"), the same dual-target scheme described herein may be used during that transition. The dual-target formulation disclosed here is generally applicable when expanding from any gamut to a wider gamut.

DETAILED DESCRIPTION

Figure 1:
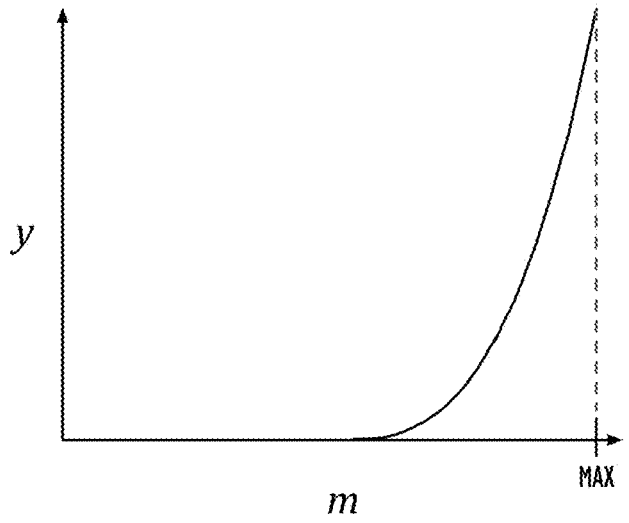
FIG. 1 shows a blending function in accordance with one embodiment.

This disclosure pertains to systems, methods, and computer readable media for successfully rendering wide-gamut images. In general, techniques are disclosed for displaying wide-gamut images as intended on color-managed wide-gamut display systems while rendering a visually consistent image when rendered on targeted narrow-gamut display systems (regardless of whether the narrow-gamut displays are color-managed). For this reason, an image represented in accordance with this disclosure is referred to as a dual-target image (DTI): one target being the image's original wide-gamut color space, the other target being a specified narrow-gamut color space. In one embodiment, the wide-gamut image may be an image represented in the P3 color space. In another embodiment, the wide-gamut image may be an image represented in the Reference Output Medium Metric (ROMM) RGB color space (also referred to as the ProPhoto RGB color space). The narrow-gamut image may, for example, be the sRGB color space although any color space that is smaller than, and wholly enclosed by, the wider gamut color space may be used. Conversely, the wide-gamut color space may be any color space that is larger than, and wholly encloses, the narrow-gamut color space. The novel representational scheme described herein retains narrow-gamut rendering for those colors in a wide-gamut image that are within the targeted narrow-gamut color space, transitioning to wide-gamut rendering for those colors in the wide-gamut image that are outside the targeted narrow-gamut color space. This approach avoids or minimizes pixel clipping when rendering a wide-gamut image for a narrow-gamut display, while allowing the original wide-gamut pixel values to be recovered when rendering for a wide-gamut display.

In the following description, for purposes of explanation, numerous specific details are set forth in order to provide a thorough understanding of the disclosed concepts. As part of this description, some of this disclosure's drawings represent structures and devices in block diagram form in order to avoid obscuring the novel aspects of the disclosed concepts. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the disclosed subject matter, and multiple references to "one embodiment" or "an embodiment" should not be understood as necessarily all referring to the same embodiment.

It will be appreciated that in the development of any actual implementation (as in any software and/or hardware development project), numerous decisions must be made to achieve the developers' specific goals (e.g., compliance with system- and business-related constraints), and that these goals may vary from one implementation to another. It will also be appreciated that such development efforts might be complex and time-consuming, but would nevertheless be a routine undertaking for those of ordinary skill in the design and implementation of graphics processing systems having the benefit of this disclosure.

Due to the nature of commonly seen object surface reflectance properties and natural illuminants, most colors in images captured using consumer-grade cameras fall into the sRGB color gamut. Notwithstanding this fact, highly saturated colors such as some flowers, car paint and colorful fabrics, especially when captured under bright illumination, may be outside the sRGB gamut. As a consequence, their color values can be clipped when rendered for an sRGB display. In light of this recognition, the remainder of this disclosure will assume the target narrow-gamut color space is the sRGB color space. This selection, while providing a solution to a current technological problem (the display of wide-gamut images on narrow-gamut display devices), should not be considered limiting. As noted above, the dual-target formulation disclosed here is generally applicable when expanding from any gamut to a wider gamut.

To begin, let $A_1$ represent a color matrix that transforms color values in a wide-gamut color space $S_0$ (e.g., P3) to a smaller-gamut color space $S_1$ (e.g., sRGB). Let:

$$A_t=\{(1-k)A_1+kI\} \quad \text{EQ. 1}$$

be the color matrix that transforms values from $S_0$ to an image-specific wide-gamut color space $S_t$ given the image's gamut size k. As used herein, the phrase "image-specific gamut" means a gamut just large enough to include the colors of a specific wide-gamut image as characterized by the image's gamut size metric k (described below). For a pixel with $S_0$ color values $[r_0, g_0, b_0]$, its $S_1$ color values may be given as:

$$[r_1,g_1,b_1]=(A_1[r_0,g_0,b_0]^t). \quad \text{EQ. 2}$$

and its $S_t$ color values as:

$$[r_t,g_t,b_t]=(A_t[r_0,g_0,b_0]^t). \quad \text{EQ. 3}$$

For colors that are not likely to be out of the $S_1$ gamut, it has been found desirable to keep their $S_1$ color values as much as possible. For color values closer to the $S_1$-$S_0$ gamut boundary (i.e., close to "entering" the $S_0$ gamut), it may be desirable to gradually transition to a $S_t$ rendering to preserve the color information.

Let 'y' represent a weight value that roughly represents the likelihood a pixel having the $S_0$ color $[r_0, g_0, b_0]$ might be clipped if converted to an $S_1$ value. This may be represented formally as:

$$y=F[r_0,g_0,b_0] \quad \text{EQ. 4}$$

Dual-target rendering $[r_x, g_x, b_x]$ for a pixel having $S_0$ color values $[r_0, g_0, b_0]$ may then be found as a y-weighted combination of $S_0$ and $S_t$ rendering as follows:

$$[r_x,g_x,b_x]^t=(1-y)A_1[r_0,g_0,b_0]^t+yA_t[r_0,g_0,b_0]^t \quad \text{EQ. 5A}$$

$$=[(1-y)A_1+yA_t][r_0,g_0,b_0]^t \quad \text{EQ. 5B}$$

The function 'F' to determine y for a given pixel may take any of a number of different forms. It is not critical to use any particular form as long as it results in a value $[r_x, g_x, b_x]$ that is perceptually close to $A_1[r_0, g_0, b_0]$ for most pixels. In one embodiment, F may be specified as a function of a pixel's maximum RGB value 'm':

$$y=F(m) \quad \text{EQ. 6A}$$

and $$m=\max(r_0,g_0,b_0). \quad \text{EQ. 6B}$$

When F takes on the form shown in FIG. 1, the value of y increases as $\max(r_0, g_0, b_0)$ gets closer to a maximum value where the likelihood increases that the $S_1$ rendering of a $S_0$ pixel will be clipped. In another embodiment, m may be the luma value of $[r_0, g_0, b_0]$. In another embodiment, m may be a combination of luma, min-RGB, and max-RGB values. More generally, m may take on a value that reflects how likely $A_1[r_0, g_0, b_0]$ might be clipped.

From EQS. 5A and 5B, one may see that no matter how y is determined there will be a trade-off between how similar $[r_x, g_x, b_x]$ can me made equal to $A_1[r_0, g_0, b_0]$, and how well $[r_0, g_0, b_0]$ may be recovered from $[r_x, g_x, b_x]$. The more similar $[r_x, g_x, b_x]$ is to $A_1[r_0, g_0, b_0]$, the more likely the values will be clipped thus making it harder to recover $[r_0, g_0, b_0]$. In addition, the transition to wide-gamut rendering at highlights will inevitably desaturate these highlight colors to some degree, making them less colorful than their $S_1$ rendering if viewed on target narrow-gamut display systems (e.g., sRGB display systems). In response to this problem, a slight darkening of highlight colors at the $S_1$ to $S_t$ transition may be made to reduce the perceived desaturation and to further minimize the clipping of $[r_x, g_x, b_x]$:

$$[r_x, g_x, b_x]^t = \left\{\left(1-\frac{m}{m_2}\right)A_1 + \left(\frac{m}{m_2}\right)A_1 d\right\}[r_0, g_0, b_0]^t, \quad \text{if } (m \le m_2), \quad \text{EQ. 7A}$$

$$[r_x, g_x, b_x]^t = \{(1-y)A_1 d + yA_t\}[r_0, g_0, b_0]^t, \quad \text{if } (m > m_2), \quad \text{EQ. 7B}$$

where 'd' represents a darkening factor with (d=0) corresponding to maximum darkening and (d=1) corresponding to no darkening, and '$m_2$' represents the point where the function y=F(m) starts to rise above 0 (e.g., FIG. 1). The treatment illustrated by EQ. 7 has been found to change an image's tone property to some degree compared to a sRGB rendering, but effectively reduces both clipping and desaturation of highlight colors. With the proper choice of y and m functions a balance between tone change, color desaturation, and recoverability to $[r_0, g_0, b_0]$ may be made. What precise values y and m assume is an implementation detail and will depend upon the specific goal of the system being implemented. For example, actions in accordance with EQ. 7 may be ignored if the quality of the images determined in accordance with EQ. 5 are perceptually similar to images generated without this perturbation again, this will depend on the specific implementation.

Figure 2:
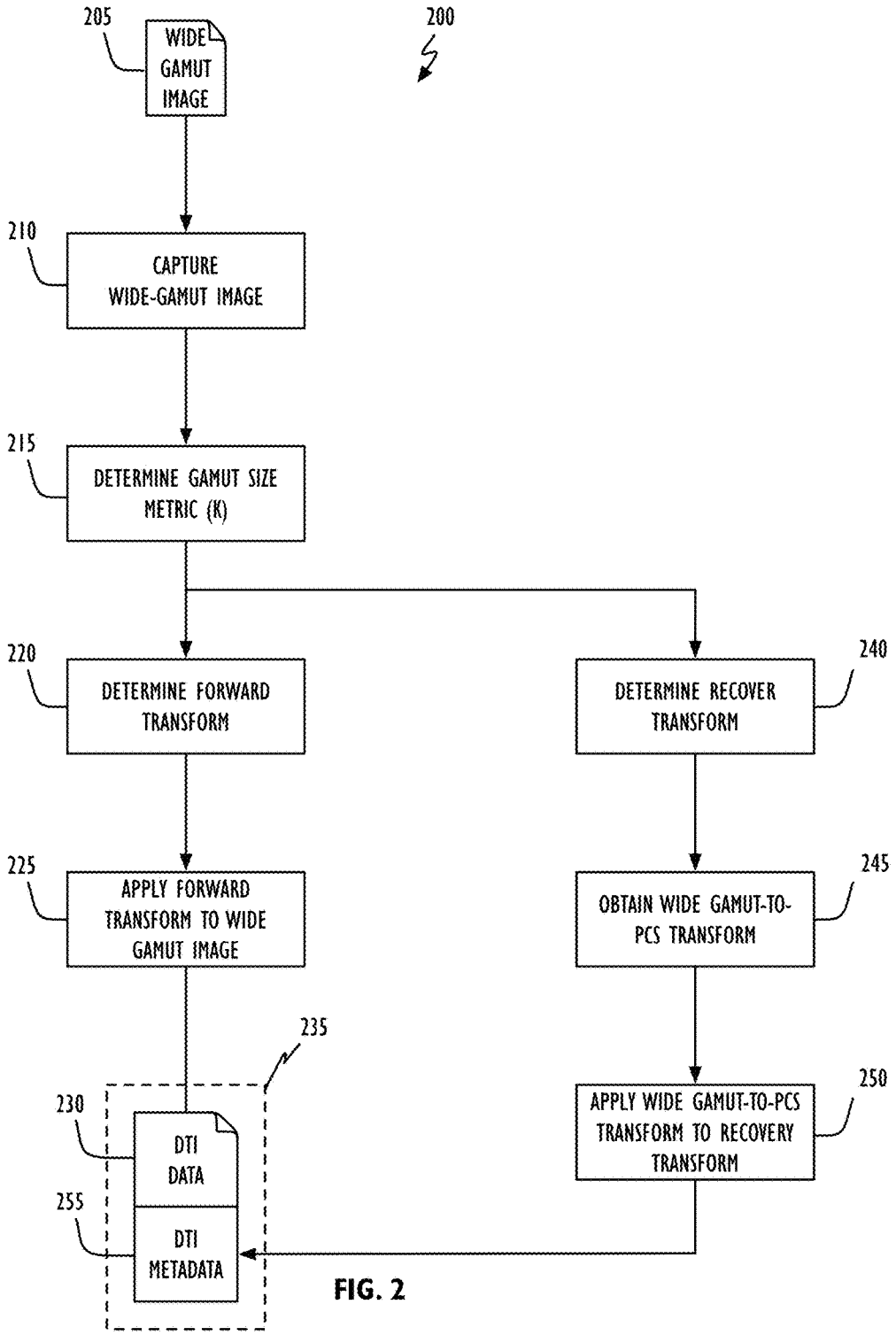
FIG. 2 shows, in flowchart form, a dual-target image generation operation in accordance with one embodiment.

Referring to FIG. 2, real-time image capture operation 200 in accordance with one embodiment may begin when wide-gamut image 205 is captured (block 210). In one embodiment, wide-gamut image 205 may be a linear color-corrected wide-gamut image. In another embodiment, wide-gamut image 205 may be a linear color-corrected and tone mapped wide-gamut image. A gamut size metric 'k' may then be determined for wide-gamut image 205 (block 215). In one embodiment, gamut size metric determination operation 215 may use a process as outlined here and described more fully in commonly owned U.S. patent application Ser. No. 14/872,114 as filed on Sep. 30, 2015 and entitled "Color Gamut Size Metric Estimation" (which is hereby incorporated by reference in its entirety). A gamut size metric as disclosed there identifies a minimum size gamut needed to encompass each pixel in an image (e.g., image 205), where the gamut size is limited at one end by a first device independent gamut (e.g., wide-gamut color space $S_0$), and at another end by a second device independent color space (e.g., narrow-gamut color space $S_1$), where $S_1$ is wholly enclosed within $S_0$. In one embodiment a gamut size metric may be based on strict pixel color value differences. In other embodiments a gamut size metric may take into account perceptual color differences and significance. By way of example, a gamut size metric k may be determined in accordance with the following:

1. Find the gamut boundary histogram of the wide-gamut image.
2. Find the n-th percentile $x_n$ of the gamut boundary histogram, where 'n' is determined according to the need of each application or implementation. In one embodiment 'n' may be taken to be a value close to 100% (e.g., 97% or 98%) or, even, 100%.
3. Considering only that portion of the gamut boundary histogram between the n-th and the 100-th percentile, treat the values in each histogram bin as weights. Find the fulcrum 'f' bin of this portion of the histogram such that the sum of moments (weight×distance) on the two sides of the fulcrum bin is equal. In practice, the fulcrum bin may resolve to a non-integer value such as 'a.b' which may be interpreted as the b % of the (a+1)-th bin value. In one embodiment, when 'a' is the last bin, f may be set to 0 f=0).
4. That gamut size corresponding to the $(x_n+f)$ bin may be taken as an estimate of the image's gamut size. As noted above, bin locations can take on non-integer values.

In one embodiment if gamut size metric k equals 0, an sRGB rendering may be performed in accordance with standard practice (the sRGB gamut is sufficient to fully display the image); if $(0<k\leq 1)$, a dual-target rendering in accordance with this disclosure may be beneficial (a gamut wider than the sRGB gamut is needed to fully display the image).

Based, at least in part, on the gamut size metric's value, a forward transformation may be determined that maps values in the wide-gamut image's color space to the target narrow-gamut color space (block 220). In one embodiment sets of forward look-up tables may be generated (one set for each value of k; each set having a table for each primary R, G and B) that map wide-gamut pixel values $[r_0, g_0, b_0]$ to dual-target gamut pixel values $[r_x, g_x, b_x]$, and which, when applied to wide-gamut image 205 (block 225), generates dual-target image (DTI) data portion 230 of DTI 235. Recovery transform (e.g., reverse look-up tables), that map DTI pixel values $[r_x, g_x, b_x]$ to wide-gamut pixel values $[r_0, g_0, b_0]$ may also be found (block 240). Forward transform in accordance with block 220 and recovery or reverse transform in accordance with block 240 may be generated in a variety of ways, the simplest of which may be to generate the mapping from $[r_0, g_0, b_0]$ to $[r_x, g_x, b_x]$ for densely sampled values of $[r_0, g_0, b_0]$ to generate forward lookup tables using equation 7, and then inverting those tables to get recovery or reverse lookup tables. In another embodiment forward transform determination 215 may initially find color matrices $A_t$ (EQ. 1) and $A_1$ as described above. Color matrices $A_t$ and $A_1$ may then be combined to generate wide-gamut-to-DTI gamut color correction matrices (CCMs) or forward lookup tables in accordance with block 220. By way of example, matrix $A_t$ may be blended with matrix $A_1$ based on per-pixel luma values to create luma-adaptive color lookup tables. Forward lookup tables may be inverted to generate recovery transform or reverse lookup tables (block 240).

There may be cases where the generated $[r_x, g_x, b_x]$ values have to be clipped to range. In such cases the recovery from $[r_x, g_x, b_x]$ values to $[r_0, g_0, b_0]$ values will not be fully accurate. The trade-off between recovery accuracy and color desaturation or darkening in the dual-target rendering is a matter of tuning. Reverse transform in accordance with block 240 may be pre-calculated for different k values and stored for use at capture time. In one embodiment, pre-calculated tables whose k value most closely matches the wide-gamut image's k value may be selected as the recovery transform. In another embodiment, pre-calculated tables whose k values are closest, but greater than and less than the wide-gamut image's k value, may be combined to generate recovery transform (e.g., through interpolation). For example, the combination may be based on a weighted sum of the two pre-calculated transforms where the difference between the pre-calculated transform's k value and the wide-gamut image's k value determines the weighting factor. In general, any means of selecting a reverse transform that permits the wide-gamut image to be restored from the DTI, within an acceptable implementation-specific error, may be used.

Since DTIs may be shared across multiple systems with varying color management capabilities, recovery operations in accordance with this disclosure may be supported by a widely used standard. ICC color profiles support the use of color lookup tables to convert input image RGB values to a device-independent color space; the profile connection space (PCS). One illustrative PCS is the CIE XYZ color space. Another illustrative PCS is the CIE LAB color space. Accordingly, ICC profiles may be used to store the metadata needed to convert DTI RGB values (expressed as $[r_x, g_x, b_x]$ tuples) to wide-gamut display-specific values (expressed as $[r_0, g_0, b_0]$ tuples). Wide-gamut-to-PCS transform tables may be obtained in accordance with the ICC standard (block 245) and applied to the recovery transform determined in accordance with block 240 (block 250) to generate metadata portion 255 of DTI 235.

While not shown explicitly in FIG. 2, wide-gamut to DTI gamut conversion in accordance with block 225 may be performed before application of the wide-gamut image's global tone curve (GTC). Since an image's GTC may be image-adaptive (i.e., based on the specific wide-gamut image), color lookup tables (CLUTs) attached to each DTI 235 (e.g., as part of DTI image metadata 255) should be able to take into account the final GTC. This may be accomplished in one embodiment by applying the wide-gamut image's GTC in both the input dimensions (that is, resampling the table on each of its 3 dimensions as if the GTC had been applied to the input image's pixel values) and to the output values of recovery lookup tables during acts in accordance with block 250. Color lookup tables generated in this manner are specific to each image. For further details on preparation of ICC profiles please refer to the ICC specification document identified above. In one embodiment, color lookup tables (e.g., used as forward and reverse transforms 220 and 240 respectively may be three-dimensional (3D) color lookup tables of size (n×n×n×3). In one particular embodiment (n=9), but may be higher or lower depending on particular application scenarios. Smaller N values may result in smaller metadata sizes and less computational load when performing inverse lookup operations. Larger N values result in larger metadata sizes and better accuracy in recovering the original wide-gamut colors. In one embodiment, the wide-gamut image's GTC may also be incorporated as part of DTI metadata 255 (as may the determined gamut size metric).

In the embodiments described above, both forward and backward transforms are provided by CLUTs. Generation of forward CLUTs are not, however, constrained to the luma-weighted blending scheme outlined earlier. By way of example, the forward CLUTs may be generated using a direct minimization of color errors (e.g., CIE DeltaE color differences) between the DTI and the original image in both the narrow-gamut rendering and the recovered wide-gamut rendering. As such, there is a great deal of freedom in how these tables may be generated to minimize loss of wide gamut information ($S_0$) and to minimize distortion of the sRGB ($S_1$) rendering when compressing the wide-gamut colors into the sRGB range. In one embodiment, these table calculations may be made offline and can be continuously improved if considered necessary.

Figure 3:
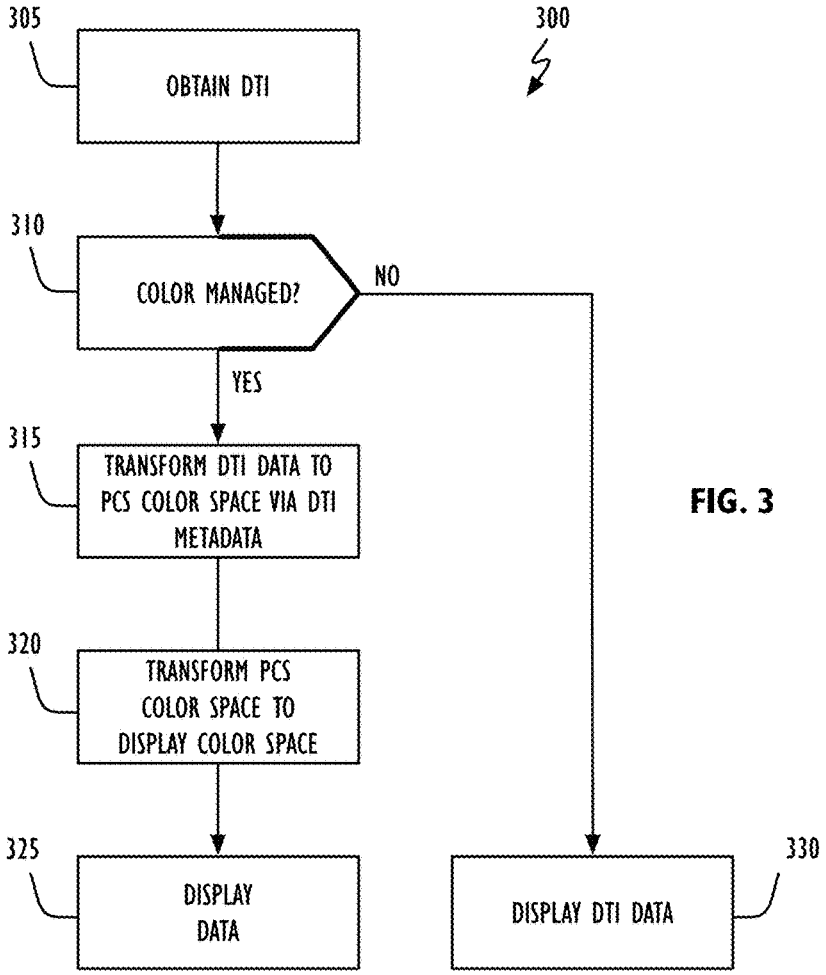
FIG. 3 shows, in flowchart form, a dual-target image use operation in accordance with one embodiment.

Referring to FIG. 3, DTI use operation 300 in accordance with one embodiment may begin when DTI 235 is obtained e.g., retrieved from memory/storage (block 305). If the target display is color managed (the "YES" prong of block 310), the display device (or some processing element acting on behalf of, or for, the display device) may transform DTI image data 230 into the PCS color space (block 315) and then into the display unit's specific color space (320) before displaying the resulting image (block 325). In one embodiment, the display unit may be a wide-gamut display. In another embodiment the display unit may be an sRGB display. If the target display is not color managed (the "NO" prong of block 310), DTI data 230 may be displayed directly by the display unit (block 330).

Figure 4:
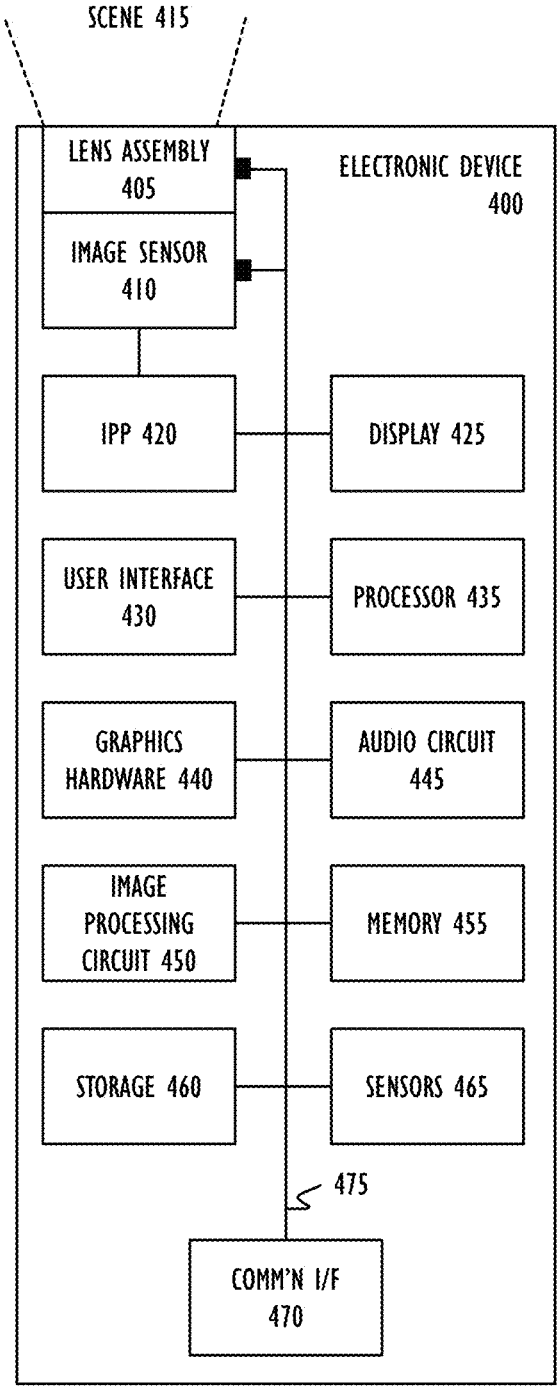
FIG. 4 shows, in block diagram form, a multi-function electronic device in accordance with one embodiment.

Referring to FIG. 4, a simplified functional block diagram of illustrative mobile electronic device 400 is shown according to one embodiment. Electronic device 400 may be used to acquire, generate or display DTIs in accordance with this disclosure (e.g., FIGS. 2 and 3). Electronic device 400 could be, for example, a mobile telephone, personal media device, a notebook computer system, or a tablet computer system. As shown, electronic device 400 may include lens assembly 405 and image sensor 410 for capturing images of scene 415. In addition, electronic device 400 may include image processing pipeline (IPP) 420, display element 425, user interface 430, processor(s) 435, graphics hardware 440, audio circuit 445, image processing circuit 450, memory 455, storage 460, sensors 465, communication interface 470, and communication link 475.

Lens assembly 405 may include a single lens or multiple lens, filters, and a physical housing unit (e.g., a barrel). One function of lens assembly 405 is to focus light from scene 415 onto image sensor 410. Image sensor 410 may, for example, be a CCD (charge-coupled device) or CMOS (complementary metal-oxide semiconductor) imager. There may be more than one lens assembly and more than one image sensor. There could also be multiple lens assemblies each focusing light onto a single image sensor (at the same or different times) or different portions of a single image sensor. IPP 420 may process image sensor output (e.g., RAW image data) to yield wide-gamut image 205. More specifically, IPP 420 may perform a number of different tasks one of which can be the conversion of a RAW image into an image represented in a linear color space (e.g., the P3, ROMM or sRGB color spaces). Other operations IPP 420 may perform include, but need not be limited to, black level removal, de-noising, lens shading correction, white balance adjustment, demosaic operations, and the application of local or global tone curves or maps. IPP 420 may comprise a custom designed integrated circuit, a programmable gate-array, a central processing unit, a graphical processing unit, memory, or a combination of these elements (including more than one of any given element). Some functions provided by IPP 420 may be implemented at least in part via software (including firmware). Display element 425 may be used to display text and graphic output as will as receiving user input via user interface 430. For example, display element 425 may be a touch-sensitive display screen. User interface 430 can also take a variety of other forms such as a button, keypad, dial, a click wheel, and keyboard. Processor 435 may be a system-on-chip (SOC) such as those found in mobile devices and include one or more dedicated graphics processing units (GPUs). Processor 435 may be based on reduced instruction-set computer (RISC) or complex instruction-set computer (CISC) architectures or any other suitable architecture and may include one or more processing cores. Graphics hardware 440 may be special purpose computational hardware for processing graphics and/or assisting processor 435 perform computational tasks. In one embodiment, graphics hardware 440 may include one or more programmable GPUs each of which may have one or more cores. Audio circuit 445 may include one or more microphones, one or more speakers and one or more audio codecs. Image processing circuit 450 may aid in the capture of still and video images from image sensor 410 and include at least one video codec. Image processing circuit 450 may work in concert with IPP 420, processor 435 and/or graphics hardware 440. Images, once captured, may be stored in memory 455 and/or storage 460. Memory 455 may include one or more different types of media used by IPP 420, processor 435, graphics hardware 440, audio circuit 445, and image processing circuitry 450 to perform device functions. For example, memory 455 may include memory cache, read-only memory (ROM), and/or random access memory (RAM). Storage 460 may store media (e.g., audio, image and video files), computer program instructions or software, preference information, device profile information, and any other suitable data. Storage 460 may include one more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Device sensors 465 may include, for example, proximity sensor/ambient light sensor, accelerometer and/or gyroscopes. Communication interface 470 may be used to connect device 400 to one or more networks. Illustrative networks include, but are not limited to, a local network such as a USB network, an organization's local area network, and a wide area network such as the Internet. Communication interface 470 may use any suitable technology (e.g., wired or wireless) and protocol (e.g., Transmission Control Protocol (TCP), Internet Protocol (IP), User Datagram Protocol (UDP), Internet Control Message Protocol (ICMP), Hypertext Transfer Protocol (HTTP), Post Office Protocol (POP), File Transfer Protocol (FTP), and Internet Message Access Protocol (IMAP)). Communication link 475 may be a continuous or discontinuous communication path and may be implemented, for example, as a bus, a switched interconnect, or a combination of these technologies.

Figure 5:
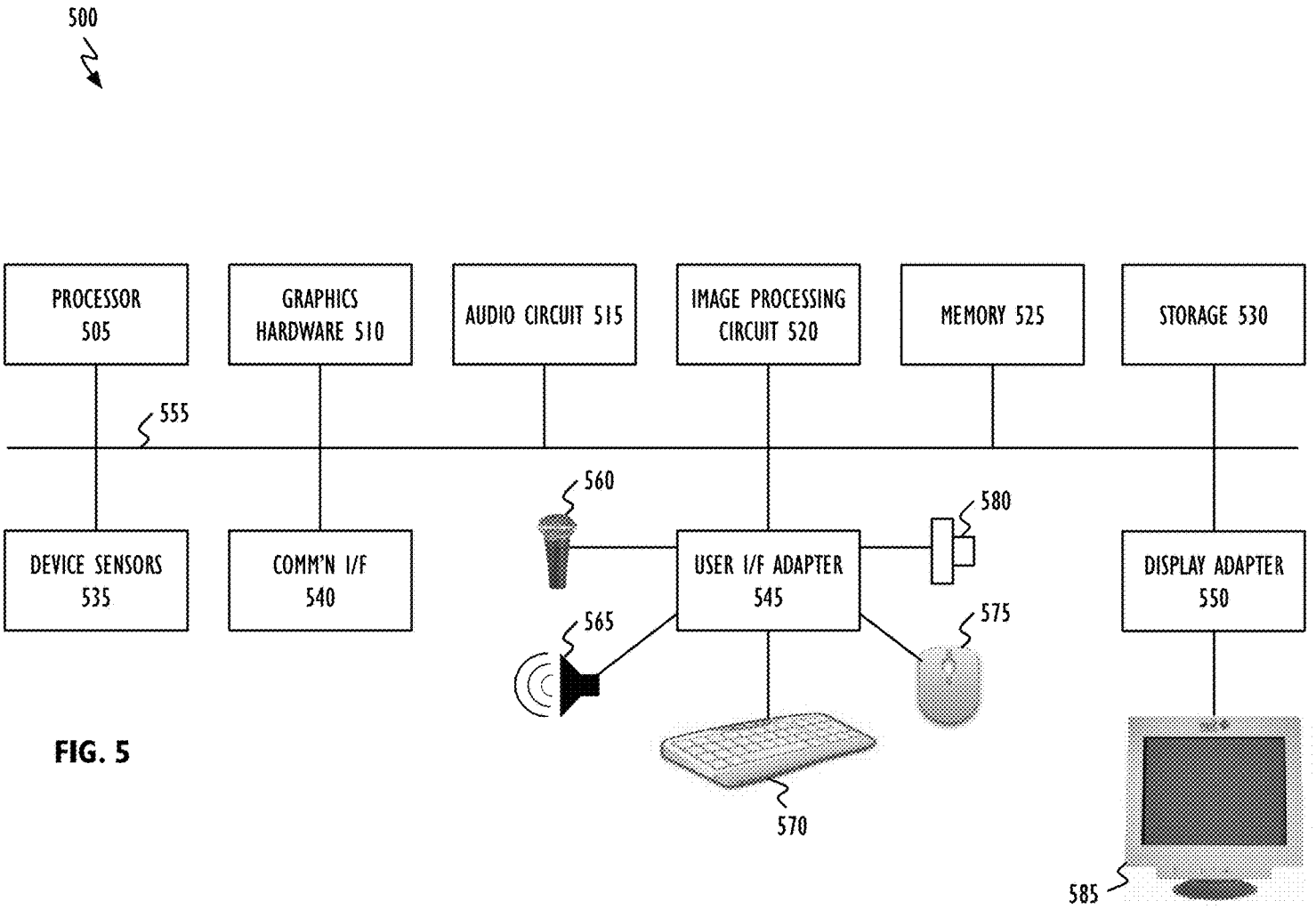
FIG. 5 shows, in block diagram form, a computer system in accordance with one embodiment.

Referring to FIG. 5, computer system 500 may be used to implement any of the methods or operations described herein. Computer system 500 could, for example, be a general purpose computer system such as a desktop, laptop, notebook or tablet computer system. Computer system 500 may include one or more processors 505, graphics hardware 510, audio circuit 515, image processing circuit 520, memory 525, storage 530, device sensors 535, communication interface 540, user interface adapter 545, and display adapter 550 all of which may be coupled via communication link 555. Processors 505, graphics hardware 510, audio circuit 515, image processing circuit 520, memory 525, storage 530, device sensors 535, communication interface 540, and communication link 555 may be of the same or similar type and serve the same function as the similarly named component described above with respect to FIG. 4. User interface adapter 545 may be used to connect devices such as microphone(s) 560, speaker(s) 565, keyboard(s) 570, cursor control device 575 and image capture unit 580 and other user interface devices such as a touch-pad. Any one or more of these elements may be built-into computer system 500. For example, microphone(s) 560 and image capture unit 580 may be built into the structure of computer system 500. Display adapter 550 may be used to connect one or more display units 585 which may provide touch input capability. As with user interface elements, display 585 may be integral to the structure of computer system 500. By way of example, image capture unit 580 may capture an image which may be processed by image processing circuit 520 and processor 505 to generate a dual-target image (DTI) in accordance with this disclosure which may then be retained in memory 525, placed into storage 530 and/or transmitted to another device via communication interface 540.

It is to be understood that the above description is intended to be illustrative, and not restrictive. The material has been presented to enable any person skilled in the art to make and use the disclosed subject matter as claimed and is provided in the context of particular embodiments, variations of which will be readily apparent to those skilled in the art (e.g., some of the disclosed embodiments may be used in combination with each other). For example, FIGS. 2-3 show flowcharts illustrating both the generation of a dual-target image and its use in accordance with the disclosed embodiments. In one or more embodiments, one or more of the disclosed steps may be omitted, repeated, and/or performed in a different order than that described herein. Accordingly, the specific arrangement of steps or actions shown in these figures should not be construed as limiting the scope of the disclosed subject matter. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A dual-target image method, comprising:

receiving a first wide-gamut image data of a scene encoded in a first wide-gamut color space;

obtaining a first forward transform to convert the first wide-gamut image data to a first narrow-gamut image data, the first narrow-gamut image data having a first narrow-gamut color space, wherein the first wide-gamut color space encloses the first narrow-gamut color space;

applying the first forward transform to the first wide-gamut image data to generate the first narrow-gamut image data;

obtaining a first reverse transform to convert the first narrow-gamut image data to a second wide-gamut image data, the second wide-gamut image data having the first wide-gamut color space;

generating a first dual-target image file having a first data portion and a first metadata portion;

storing the first narrow-gamut image data in the first data portion;

storing the first reverse transform in the first metadata portion; and displaying the first dual-target image file on a display based, at least in part, on whether the display is color managed.

2. The method of claim 1, further comprising determining a first gamut size metric of the first wide-gamut image data.

3. The method of claim 2, further comprising storing the first gamut size metric in the first metadata portion.

4. The method of claim 2, wherein obtaining a first reverse transform comprises obtaining the first reverse transform based on the first gamut size metric.

5. The method of claim 4, wherein obtaining the first reverse transform based on the first gamut size metric comprises selecting the first reverse transform from a first set of pre-determined reverse transforms, wherein each reverse transform of the first set of pre-determined reverse transforms is based on the first gamut size metric.

6. The method of claim 1, further comprising:

obtaining a second dual-target image file, the second dual-target image file comprising a second narrow-gamut image data in a second data portion and a second reverse transform in a second metadata portion, wherein the second narrow-gamut image data is encoded in the first narrow-gamut color space;

displaying, on the display, the second narrow-gamut image data when the display is not color managed;

displaying, on the display, the second narrow-gamut image data when the display is color managed and configured to display images in the first narrow-gamut color space; and when the display is color managed and configured to display images in the first wide-gamut color space— obtaining the second reverse transform from the second metadata portion, converting the second narrow-gamut image data to a second wide-gamut image data based on the second reverse transform, wherein the second wide-gamut image data is encoded in the first wide-gamut color space, and displaying the second wide-gamut image data on the display.

7. The method of claim 6, wherein converting the second narrow-gamut image data to a second wide-gamut image data comprises:

obtaining a second gamut size metric from the second metadata portion; and selecting the second reverse transform from a plurality of second reverse transforms based on the second gamut size metric.

8. A non-transitory program storage device comprising instructions stored thereon to cause one or more processors to:

receive a first wide-gamut image data of a scene encoded in a first wide-gamut color space;

obtain a first forward transform to convert the first wide-gamut image data to a first narrow-gamut image data, the first narrow-gamut image data having a first narrow-gamut color space, wherein the first wide-gamut color space encloses the first narrow-gamut color space;

apply the first forward transform to the first wide-gamut image data to generate the first narrow-gamut image data;

obtain a first reverse transform to convert the first narrow-gamut image data to a second wide-gamut image data, the second wide-gamut image data having the first wide-gamut color space;

generate a first dual-target image file having a first data portion and a first metadata portion;

store the first narrow-gamut image data in the first data portion; and store the first reverse transform in the first metadata portion.

9. The non-transitory program storage device of claim 8, further comprising instructions to cause the one or more processors to determine a first gamut size metric of the first wide-gamut image data.

10. The non-transitory program storage device of claim 9, further comprising instructions to cause the one or more processors to store the first gamut size metric in the first metadata portion.

11. The non-transitory program storage device of claim 9, wherein the instructions to cause the one or more processors to obtain a first reverse transform comprise instructions to cause the one or more processors to obtain the first reverse transform based on the first gamut size metric.

12. The non-transitory program storage device of claim 11, wherein the instructions to cause the one or more processors to obtain the first reverse transform based on the first gamut size metric comprise instructions to cause the one or more processors to select the first reverse transform from a first set of pre-determined reverse transforms, wherein each reverse transform of the first set of pre-determined reverse transforms is based on the first gamut size metric.

13. The non-transitory program storage device of claim 8, further comprising instructions to cause the one or more processors to:

obtain a second dual-target image file, the second dual-target image file comprising a second narrow-gamut image data in a second data portion and a second reverse transform in a second metadata portion, wherein the second narrow-gamut image data is encoded in the first narrow-gamut color space;

display, on a display, the second narrow-gamut image data when the display is not color managed;

display, on the display, the second narrow-gamut image data when the display is color managed and configured to display images in the first narrow-gamut color space; and when the display is color managed and configured to display images in the first wide-gamut color space— obtain the second reverse transform from the second metadata portion, convert the second narrow-gamut image data to a second wide-gamut image data based on the second reverse transform, wherein the second wide-gamut image data is encoded in the first wide-gamut color space, and display the second wide-gamut image data on the display.

14. The non-transitory program storage device of claim 13, wherein the instructions to cause the one or more processors to convert the second narrow-gamut image data to a second wide-gamut image data comprise instructions to cause the one or more processors to:

obtain a second gamut size metric from the second metadata portion; and select the second reverse transform from a plurality of second reverse transforms based on the second gamut size metric.

15. An electronic device, comprising:

an image capture element;

memory coupled to the image capture unit;

a display unit coupled to the memory;

a communication interface coupled to the memory; and one or more processors coupled to the image capture element, the memory, the display unit and the communication interface, wherein the one or more processors are configured to execute program instructions stored in the memory to cause the electronic device to— obtain, from the memory, a first wide-gamut image data of a scene encoded in a first wide-gamut color space, obtain a first forward transform to convert the first wide-gamut image data to a first narrow-gamut image data, the first narrow-gamut image data having a first narrow-gamut color space, wherein the first wide-gamut color space encloses the first narrow-gamut color space, apply the first forward transform to the first wide-gamut image data to generate the first narrow-gamut image data, obtain a first reverse transform to convert the first narrow-gamut image data to a second wide-gamut image data, the second wide-gamut image data having the first wide-gamut color space, generate a first dual-target image file having a first data portion and a first metadata portion, store the first narrow-gamut image data in the first data portion, store the first reverse transform in the first metadata portion, and store the first dual-target image file in the memory.

16. The electronic device of claim 15, further comprising program instructions to cause the electronic device to determine a first gamut size metric of the first wide-gamut image data.

17. The electronic device of claim 16, further comprising program instructions to cause the electronic device to store the first gamut size metric in the first metadata portion.

18. The electronic device of claim 16, wherein the program instructions to cause the electronic device to obtain a first reverse transform comprise program instructions to cause the electronic device to obtain the first reverse transform based on the first gamut size metric.

19. The electronic device of claim 18, wherein the program instructions to cause the electronic device to obtain the first reverse transform based on the first gamut size metric comprise program instructions to cause the electronic device to select the first reverse transform from a first set of pre-determined reverse transforms, wherein each reverse transform of the first set of pre-determined reverse transforms is based on the first gamut size metric.

20. The electronic device of claim 15, further comprising program instructions to cause the electronic device to:

obtain a second dual-target image file, the second dual-target image file comprising a second narrow-gamut image data in a second data portion and a second reverse transform in a second metadata portion, wherein the second narrow-gamut image data is encoded in the first narrow-gamut color space;

display, on the display unit, the second narrow-gamut image data when the display unit is not color managed;

display, on the display unit, the second narrow-gamut image data when the display unit is color managed and configured to display images in the first narrow-gamut color space; and when the display unit is color managed and configured to display images in the first wide-gamut color space— obtain the second reverse transform from the second metadata portion, convert the second narrow-gamut image data to a second wide-gamut image data based on the second reverse transform, wherein the second wide-gamut image data is encoded in the first wide-gamut color space, and display the second wide-gamut image data on the display unit.

21. The electronic device of claim 20, wherein the program instructions to cause the electronic device to convert the second narrow-gamut image data to a second wide-gamut image data comprise program instructions to cause the electronic device to:

obtain a second gamut size metric from the second metadata portion; and select the second reverse transform from a plurality of second reverse transforms based on the second gamut size metric.

* * * * *